US005816841A

United States Patent [19]

Grant

[11] Patent Number: 5,816,841

[45] Date of Patent: Oct. 6, 1998

[54] ELECTRICAL DISCONNECT FOR TELEPHONE HEADSET

[75] Inventor: John L. Grant, Sherborn, Mass.

[73] Assignee: ACS Wireless, Inc., Scotts Valley, Calif.

[21] Appl. No.: 419,892

[22] Filed: Apr. 11, 1995

[51] Int. Cl.[6] ..... H01R 13/627

[52] U.S. Cl. ..... 439/354; 439/417; 439/677; 439/699.1

[58] Field of Search ..... 439/677, 353, 439/354, 357, 358, 344, 425, 418, 417, 409, 410, 660, 732, 931

[56] References Cited

U.S. PATENT DOCUMENTS

| | | | |
|---|---|---|---|
| 1,072,460 | 9/1913 | Hoffmann | 439/159 |
| 2,446,232 | 8/1948 | Koenig | 439/746 |
| 3,701,084 | 10/1972 | Gomez | 339/66 M |
| 3,842,393 | 10/1974 | Glover et al. | 339/60 M |
| 4,008,940 | 2/1977 | Foley | 339/91 R |
| 4,403,824 | 9/1983 | Scott | 439/680 |
| 4,449,776 | 5/1984 | Carmo et al. | 339/91 R |
| 4,516,822 | 5/1985 | Wolfel | 439/425 |
| 4,822,297 | 4/1989 | Prince et al. | 439/395 |
| 4,842,546 | 6/1989 | Song | 439/425 |
| 5,213,514 | 5/1993 | Arai | 439/82 |
| 5,362,249 | 11/1994 | Carter | 439/357 |
| 5,415,562 | 5/1995 | Matsumoto et al. | 439/417 |
| 5,573,421 | 11/1996 | Reichle | 439/417 |
| 5,575,688 | 11/1996 | Crane, Jr. | 439/660 |

FOREIGN PATENT DOCUMENTS

| | | | |
|---|---|---|---|
| 0 338 727 A2 | 10/1989 | European Pat. Off. | H01R 13/506 |
| 1 031 859 | 6/1958 | Germany . | |
| 2259231 | 6/1974 | Germany | 439/677 |
| 85 33 714.5 | 2/1987 | Germany | H01R 13/11 |
| 1029090 | 5/1966 | United Kingdom | 439/677 |

OTHER PUBLICATIONS

Invitation to Pay Additional Fees from the International Searching Authority, in PCT/US96/04539, mailed Aug. 7, 1996, 4 pages in length.

Notification of Transmittal of the International Search Report or the Declaration, from the International Searching Authority, in PCT/US96/04539, mailed Oct. 9, 1996, 6 pages in length.

*Primary Examiner*—Neil Abrams
*Assistant Examiner*—Christopher Goins
*Attorney, Agent, or Firm*—Limbach & Limbach L.L.P.

[57] ABSTRACT

An electrical connector is disclosed, designed for use with a telephone headset. The connector utilizes angled contacts for low insertion force, resulting in easier mating and longer life. The connector is provided with a latch that allows the connector to be uncoupled with a force roughly eight times the insertion force. Both halves of the connector have beveled edges on the upper surfaces only, allowing the connector to be aligned by tactile feel rather than visual inspection or by trial and error. Fine wires can be terminated on the connector contacts because the wires are accurately centered over insulation piercing points on the electrical contacts, and expansion of the wires in all directions is restricted as the piercing points penetrate the wire.

6 Claims, 10 Drawing Sheets

ELECTRICAL DISCONNECT FOR TELEPHONE HEADSET

BACKGROUND OF THE INVENTION

1. Field of the Invention

The present invention relates to an electrical connector, and in particular to quick disconnect for use with a telephone headset.

2. Discussion of the Prior Art

Lightweight telephone headsets are widely utilized to allow a user to communicate through a telephone without having to hold a receiver up to his or her ear. A typical headset includes at least one receiver positioned over or inside an ear, and a microphone boom extending to adjacent the user's mouth. An amplifier is typically interconnected between the telephone base and the headset. A coiled cord is typically provided between the amplifier and the headset. It is desirable to have a releasable connector located on the cord connecting the headset to the amplifier to allow the user to "unplug" from the phone and be able to walk around with the headset when not using the phone. Preferably, the connector is located at about waist level so that it is easily accessible and there is a minimum amount of cord hanging from the headset when unplugged. The headset side of the cord may be equipped with a clip to attach it to the user's clothing in order keep the cord from swinging around.

Electrical disconnects used in conjunction with a telephone headset must meet a number of special requirements not required of typical connectors. Because the voltage in the cable between the headset and the amplifier is very low, the mating contacts in the connector must make good electrical contact with very low electrical resistance. This good electrical contact must be maintained as the connector is jostled when the headset user is moving around. This in turn makes it desirable for the contacts within the connector to be plated with a highly conductive, inert material such as gold, and requires that the contacts be biased together with a relatively high force when the connector is coupled together. It is also desirable to have a connector that can withstand being mated and disconnected many times, preferable over 50,000 mating cycles before starting to fail. The higher the mating force, the more quickly the contacts begin to wear and lose their plating as they wipe across each other during mating. Therefore, generally speaking, the better the connection, the shorter the life of the connector. It would be desirable for a connector to be able to releasably maintain a reliable low-voltage connection throughout a life of over 50,000 mating cycles.

Terminating the cable conductors inexpensively but reliably on the contacts within the connector is another difficulty. Because it is desirable to have lightweight and highly flexible cable for greater user comfort and cable bend life, ribbon cable and heavy gauge conductors can not be used. Rather, it is desirable to use cable having discrete, insulated, fine conductors. These conductors have a diameter considerably smaller than those used in typical connectors, such as modular phone plugs. These small wires are difficult to strip or align with insulation piercing points. It would be desirable to inexpensively align these wires with their respective contacts during assembly and make reliable electrical connections between the wires and the contacts without any stripping, soldering, or crimping tools.

Most electrical connectors are polarized so that they may only be connected in one orientation. To mate the connector, the user must typically look at the keying features on both halves of the connector and visually align the halves before mating, or attempt to align the halves by trial and error. Visual alignment, especially on small connectors, requires extra time and diverts the user's eyes away from other tasks. It would be desirable for a connector to be quickly and easily mated without having to look at it.

Many connectors have latching features that must be manually actuated to lock or release the connector. These features are utilized to prevent accidental release, such as when a headset cord is tugged on when the user turns in his or her chair or reaches for something. Typically, these connectors are difficult to lock and release. It would be desirable for a connector to require little force to lock, to resist releasing up to a larger specified force, and be easily releasable simply by applying a force slightly higher than the specified force.

What is needed and has not been provided by the prior art is a low cost electrical connector for a highly flexible headset cable, that provides a reliable low-voltage connection over many mating cycles, while being easy to connect and release simply by feel.

SUMMARY OF THE INVENTION

The present invention is directed to an improved electrical connector which provides all of the above desirable features and advantages while remaining relatively small, lightweight, and inexpensive to manufacture and assemble.

In accordance with one aspect of the present invention, one half of the inventive connector is provided with pairs of contacts which are oriented at an angle with respect to one another such that each pair forms a wedge, preferably having an included angle of 10°. Mating contacts in the other half of the connector are increasingly separated by the wedges as one half is inserted farther into the other half. This configuration provides for better initial contact alignment which prevents "stubbing" (one contact bending the other), and provides a much lower initial contact force than conventional connectors. The lower initial contact force reduces insertion force for easier mating, and reduces wear from contact wiping to increase connector life. Contact force is high when the connector is fully mated, providing a good low-voltage connection.

In accordance with another aspect of the invention, electrical contacts within both connector halves are provided with insulation piercing points for termination of the cable conductors onto the contacts. Discrete cable wire are aligned and restrained by a series of posts and channels in the lower portion of each connector half. A series of corresponding ridges located in the upper portion of each connector half force the wires over the piercing points when the upper and lower portion of each half are assembled together. Wires of small diameter can be reliably terminated because the wires are accurately aligned over the piercing points and restrained from all sides while being pierced.

In accordance with yet another aspect of the invention, the upper longitudinal edges of both halves of the connector are beveled, while the lower edges of both halves are non-beveled. The same is true for a protrusion located on one half that is receivable within a keyed aperture located in the other half. The upper corners of the aperture are beveled and the lower corners are non-beveled to match the protrusion, thereby allowing the protrusion to be received within the aperture in only one orientation. The beveled edges on the upper longitudinal edges of both halves can be tactilely distinguished from the non-beveled edges, thereby allowing the user to easily pre-align the two halves without looking, so that the protrusion is properly aligned with the aperture before insertion.

In accordance with still another aspect of the invention, a latch is provided to prevent the unintentional release of the two halves of the connector. The latch includes a resilient finger on one half which is retained by a ramped surface on the other half when engaged. By selecting the proper angle on the end of the finger in conjunction with the spring force on the finger and the coefficient of friction between the finger and the ramped surface, insertion forces can be kept low for ease of use and low wear, and release forces can be kept higher to prevent unintentional release. Choosing the proper characteristics above also allows the connector to release with a more consistent force every time. This ensures that the connector is not too difficult to release some of the time, and not too easy to release at other times. The latching features are hidden within the connector when engaged, and the user need do nothing more than pull on the two halves to separate them. In the preferred embodiment, the angle of the face at the end of the finger is set at 50 degrees to the longitudinal axis of the connector, allowing the two halves to be latched with a force of one quarter pound, and to be released by a force of two pounds.

Other features and advantages of the invention will be apparent from the following description, the accompanying drawings and the appended claims.

DETAILED DESCRIPTION OF THE PREFERRED EMBODIMENT

Figure 1:
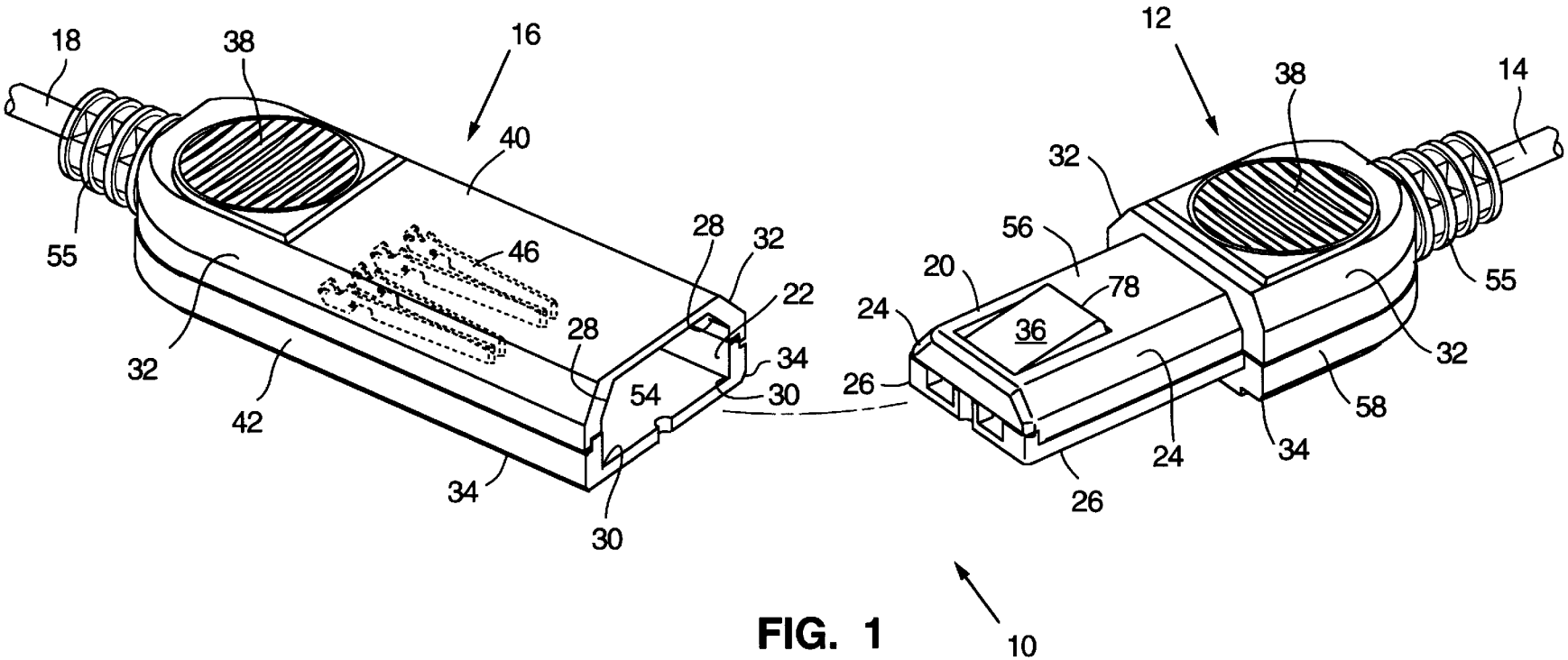
FIG. 1 is a perspective view of the inventive connector, showing the amplifier and headset segments in an uncoupled condition.

Referring to FIG. 1, the preferred embodiment of the connector 10 is shown. Connector 10 consists of two generally rectangular segments: a headset segment 12 connected to cable 14 leading to the headset (not shown), and an amplifier segment 16 connected to cable 18 leading to the amplifier (not shown).

Headset segment 12 is provided with a protrusion 20 which is receivable within aperture 22 in amplifier segment 16. Protrusion 20 has beveled edges 24 along its upper surface and non-beveled edges 26 along its lower surface. Similarly, aperture 22 has beveled corners 28 on its upper side and non-beveled corners 30 on it lower side. The matching beveled features on protrusion 20 and aperture 22 allow the two segments 12 and 16 to be connecting in only one orientation.

Both segments 12 and 16 are provided with bevels 32 on their upper longitudinal edges, while the lower longitudinal edges 34 are non-beveled. Beveled edges 32 can be distinguished from non-beveled edges 34 when the user holds segments 12 and 16 in virtually any orientation. This allows the user to easily prealign the segments 12 and 16 without having to look at them before insertion.

In the preferred embodiment, the upper surface of protrusion 20 is provided with a latching finger 36 for releasably latching headset segment 12 to amplifier segment 16. Latching finger 36 engages a recess 37 located within amplifier segment 16, as will be described in detail later with reference to FIGS. 4*b*, 5*b* and 6*b*. Finger grips 38 are formed in the top and bottom surfaces of both segments 12 and 16 to allow the user to easily pull the segments 12 and 16 apart.

Figure 2:
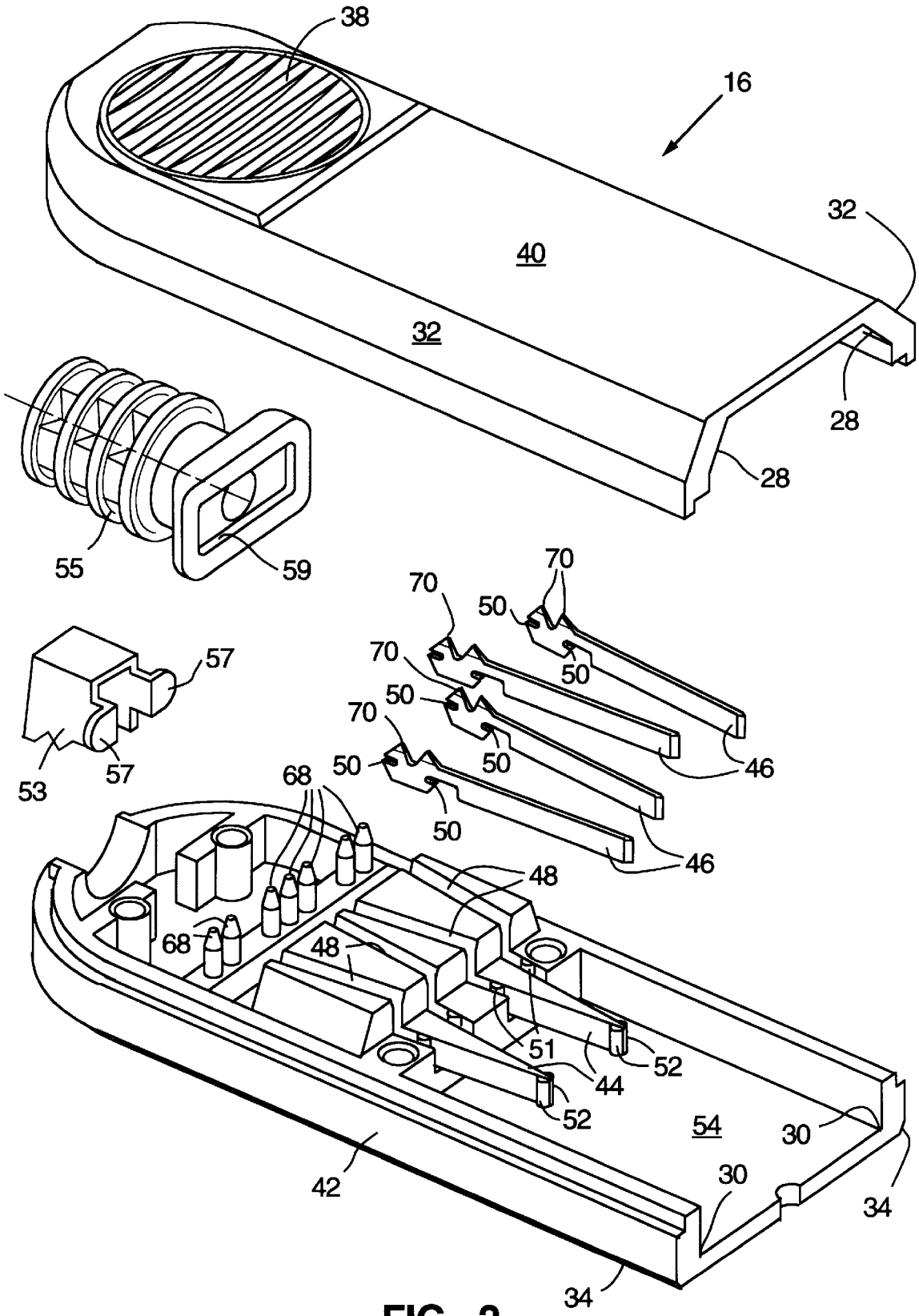
FIG. 2 is an exploded perspective view of the amplifier segment.

Referring to FIG. 2, amplifier segment 16 includes an upper shell 40 and a lower shell 42, preferably made of ABS plastic. After amplifier segment 16 has been fully assembled during manufacture, upper shell 40 and lower shell 42 are ultrasonically welded together. Two triangular insulating supports 44 are formed on lower shell 42 to support two pairs of blade contacts 46. Blade contacts 46 are secured in the bottom of angled channels 48 and extend along either side of the triangular supports 44 to form two wedges. Barbed cutouts 50 located underneath and at the rear of blade contacts 46 bite into complementary shaped features (not shown) in the bottom of channels 48 to hold blade contacts in place. Also, vertical ribs 51 are provided on opposite sides of each channel 48 (shown in FIG. 4*a*), providing an interference fit with blade contacts 46 to aid in holding them in place. Vertical ribs 52 are also located on the tips of triangular supports 44 to support each blade contact 46 in the center of its channel 48. Preferably, the blade contacts are set at a 5 degree angle relative to the longitudinal axis of the connector 10.

Blade contacts 46 are recessed back away from aperture 22 for increased electrical isolation from the exterior environment. Triangular supports 44 and blade contacts 46 are suspended above the bottom surface 54 about 0.05 inches to increase the surface distance from blade contacts 46 to aperture 22, also for increased electrical isolation.

Strain relief 53 is crimped around the end of cable 18. Strain relief 53 has winged portions 57 that prevent strain relief 53 and the end of cable 18 from being pulled out of amplifier segment 16 after upper shell 40 and lower shell 42 have been assembled together. Bellows 55 is also assembled over the end of cable 18 and is similarly held in place by flange 59 that is captivated between the upper shell 40 and lower shell 42.

Figure 3:
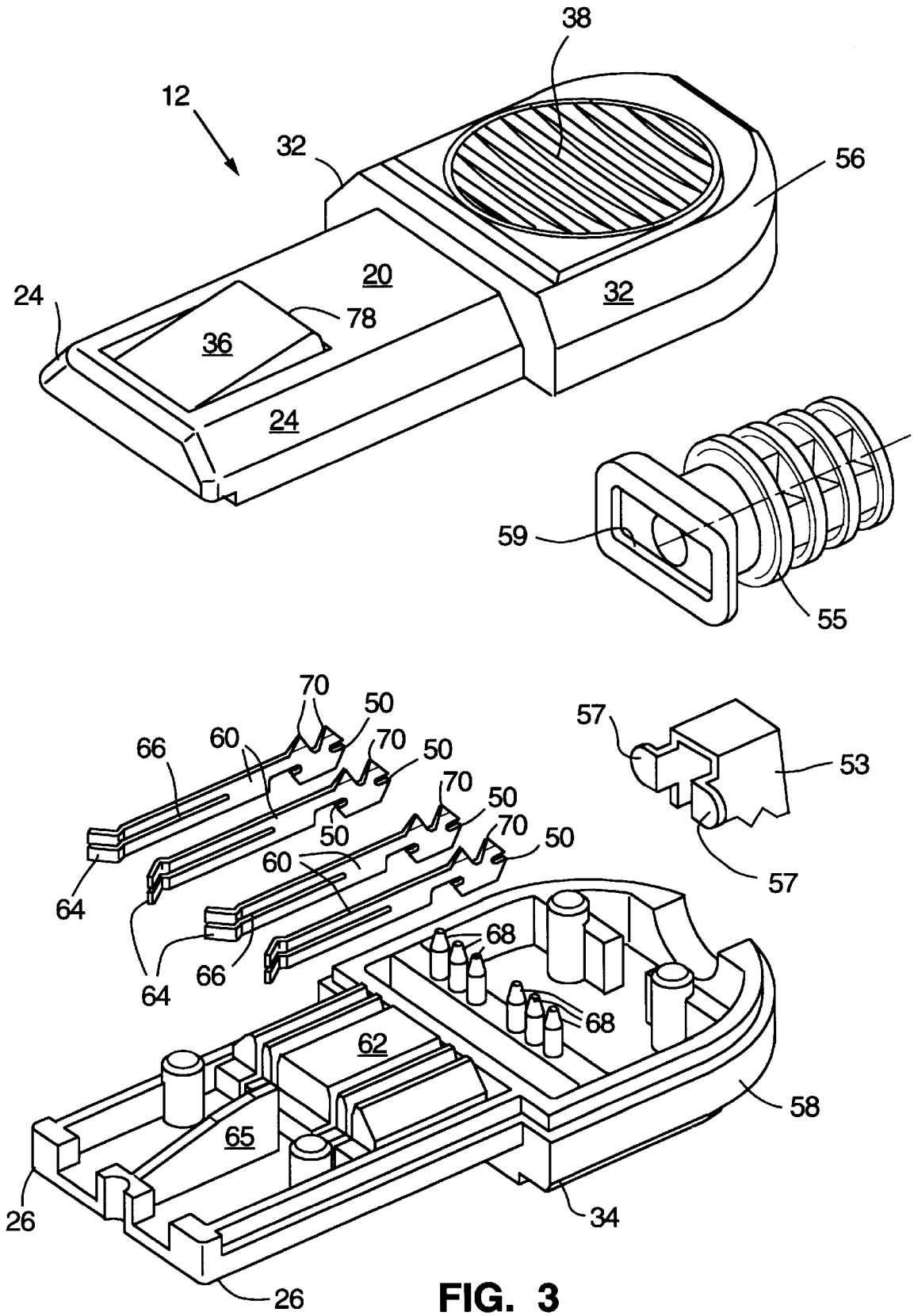
FIG. 3 is an exploded perspective view of the headset segment.

Referring to FIG. 3, headset segment 12 is constructed in a similar fashion to amplifier segment 16. Headset segment 12 has an upper shell 56 and a lower shell 58. Two pairs of spring contacts 60 are secured in the bottom of straight channels 62 in a similar manner as the blade contacts 46 described above. Preferably, the spring contacts 60 are parallel to each other as shown. Spring contacts 60 extend beyond straight channels 62 and are positioned so that each pair aligns with the corresponding pair of blade contacts 46 when protrusion 20 is inserted into aperture 22 as connector 10 is mated. The distal ends 64 of spring contacts 60 are bent outwardly to provide a "lead in" surface for initial contact with blade contacts 46.

Each spring contact 60 is bifurcated by a slit 66 which extends partially down each contact 60 from its distal end 64. This configuration produces two, independent, spring loaded contact points between each spring contact 60 and its mating blade contact 46. The purpose of the dual contact point design is to reduce or eliminate audible "static" during mating or unmating of the connector 10 while the user is wearing the attached headset. A static-like sound will result if contact is lost momentarily (for a few microseconds, for example) as the contact point slides over insulating particles, such as dust, dirt, or worn plastic particles. This can occur when spring contact 60 is sliding over blade contact 46 during mating or unmating of connector 10. Since the two contact points are electrically in parallel and each has a very low contact resistance relative to the rest of the circuit resistance (about 1 mΩ as opposed to 600 Ω), the loss of only one of the two points of contact will have negligible effect on the current flow in the rest of the circuit. In order for current flow in the circuit to be interrupted (thus causing static), both contact points would have to loose contact simultaneously. Since loss of contact at a single contact point is relatively short lived, and is a random event, the probability of loosing contact at both points simultaneously is much less than the probability of loosing contact at a single contact point.

Figure 4A:
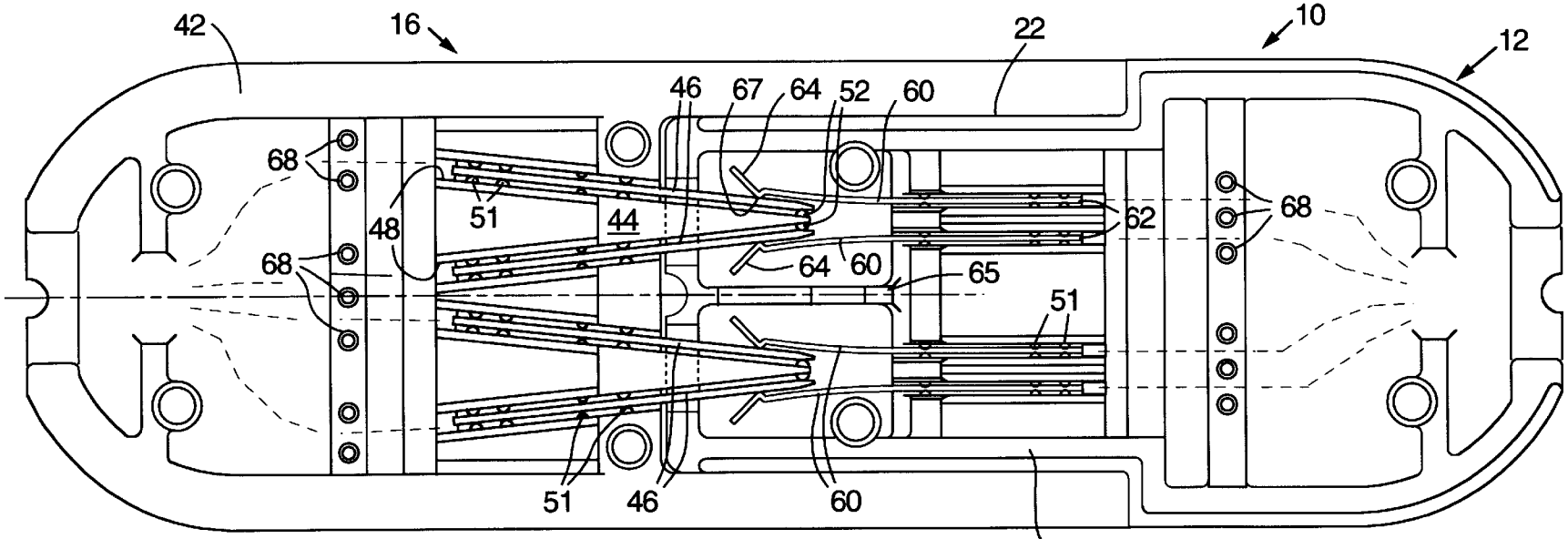
FIG. 4*a* is a plan view of the lower shells of the amplifier and headset segments in a mated condition.

Referring to FIGS. 4*a,* 4*b,* 11*b,* the segments 12 and 16 are coupled together in the latched position, and the relative positions of the spring contacts 60 on the blade contacts 46 can be seen. During initial coupling, the apex of the wedge configuration of each pair of blade contacts 46 passes between the distal ends 64 of the spring contacts 60, urging the two segments 12 and 16 further into proper alignment without contact "stubbing" or bending, as can occur in conventional connectors. As the two segments 12 and 16 are pushed further together toward the latched position (FIG. 11*a*), spring contacts 60 are biased outward and further apart from each other by the blade contacts 46.

Figure 11A:
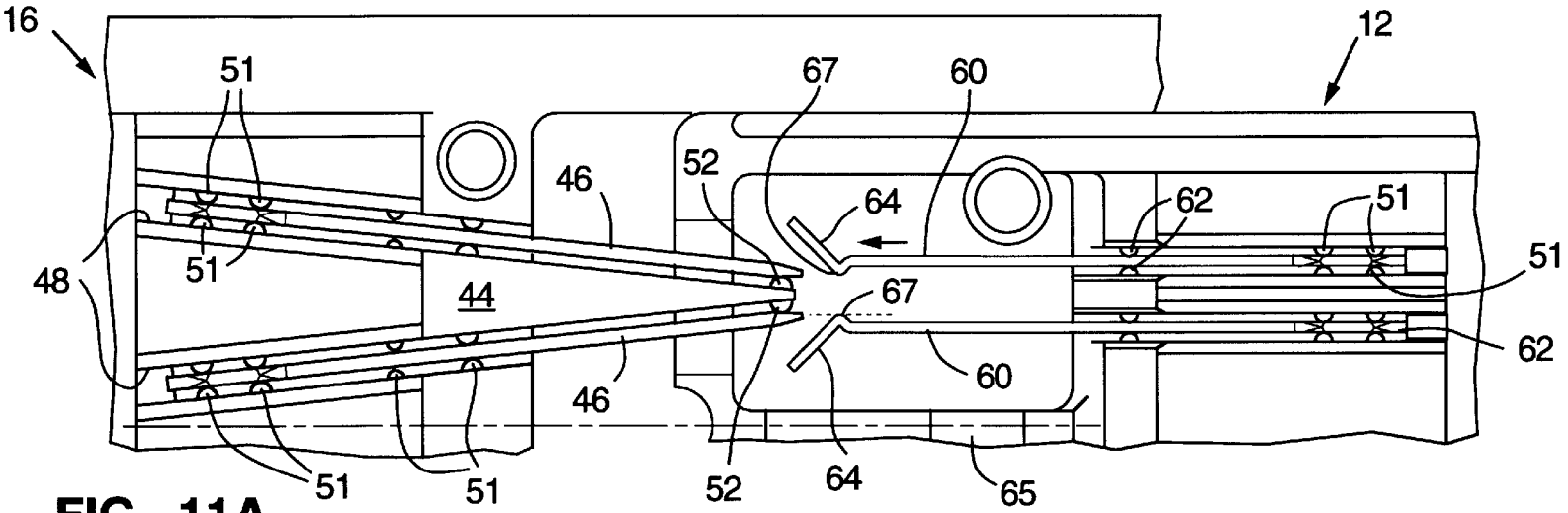
FIG. 11*a* is an enlarged partial plan view showing the spring contacts during engagement with the blade contacts.
Figure 11B:
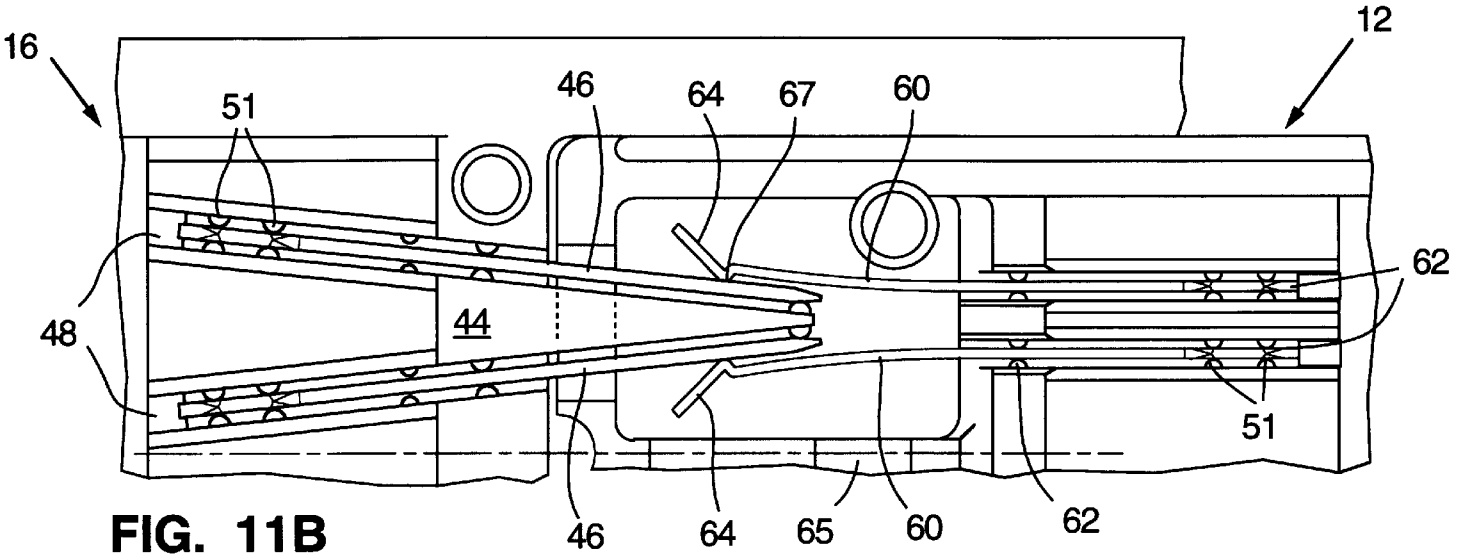
FIG. 11*b* is an enlarged partial plan view showing the spring contacts fully engaged with the blade contacts.
Figure 12:
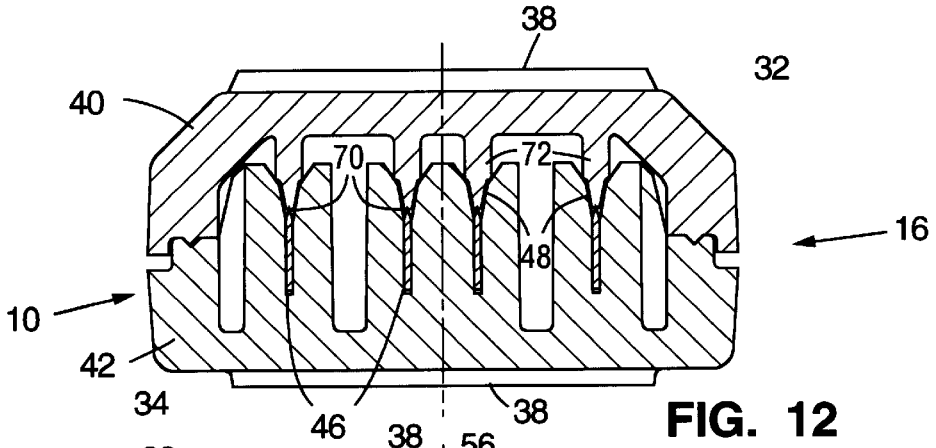
FIG. 12 is a cross-sectional end view taken along line 12—12 in FIG. 4*b*.
Figure 13:
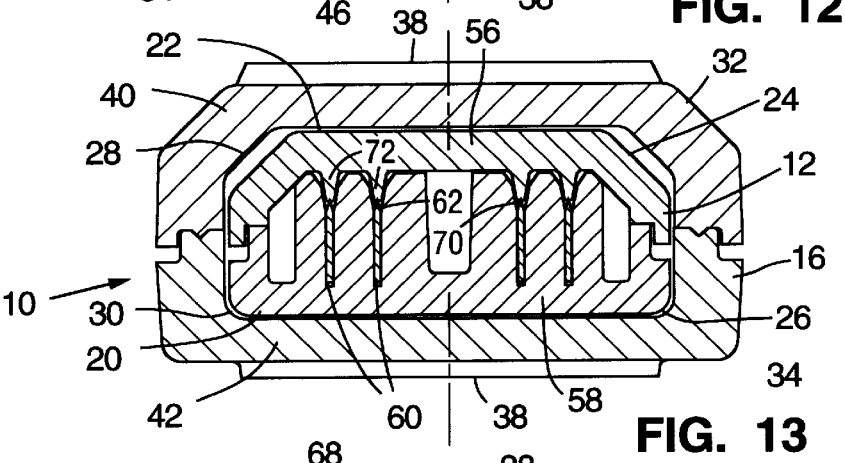
FIG. 13 is a cross-sectional end view taken along line 13—13 in FIG. 4*b*.
Figure 14:
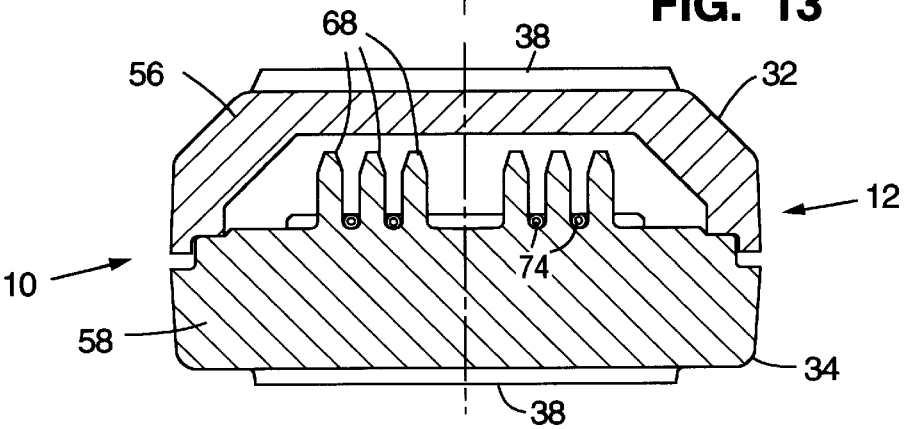
FIG. 14 is a cross-sectional end view taken along line 14—14 in FIG. 4*b*.
Figure 15:
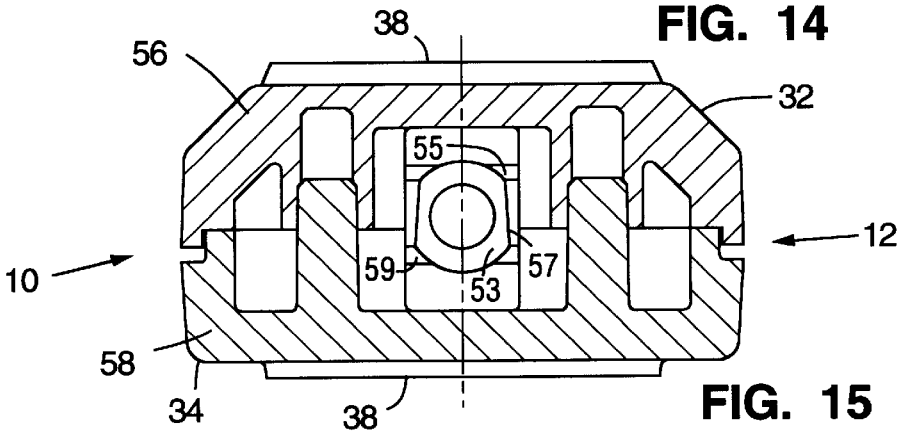
FIG. 15 is a cross-sectional end view taken along line 15—15 in FIG. 4*b*.

Referring to FIGS. 11*a* and 11*b,* an enlarged view of the electrical connection made between spring contact 60 and blade contact 46 is shown, both during and after mating, respectively. Bulges 67 are radiused contact points formed near the distal end 64 of each spring contact 60. Because spring contact 60 is preferably bifurcated, as shown in FIG. 3 and described above, two bulges 67 are formed on each spring contact 60, one directly above the other. The cylindrical shape of bulge 67 is well known in the art as a desirable shape for an electrical contact. Bulges 67 protrude approximately 0.01 inches from spring contact 60 to ensure that the contact points between spring contact 60 and blade contact 46 occur at a consistent location. By creating a consistent length between the contact points and the mounting of the spring contact 60, the perpendicular force exerted by spring contact 60 on blade contact 46 can be accurately predetermined and controlled.

Figure 7:
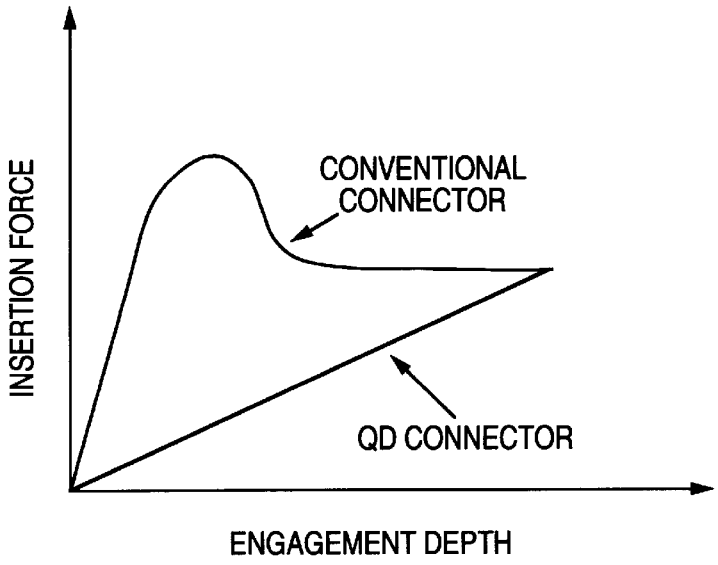
FIG. 7 is a graph comparing the general relationship between engagement depth and insertion force for the present invention and a conventional connector.

Referring to FIG. 7, the graph shows the relationship between engagement depth and insertion force for the inventive contacts as compared to contacts in a conventional connector. The insertion force shown measured along the vertical axis of the graph is also representative of the perpendicular force exerted between connector contacts. The insertion forces associated with conventional connectors tend to be quite high as the connectors halves are first being mated. The insertion force will then drop off but still remain relatively high as the engagement between the segments is completed. These high forces created when the connectors are first being mated makes the connectors harder to engage. More importantly, these high forces can significantly reduce the life of the connector as friction tends to abrade and wear the contacts when they wipe across each other.

In contrast, the insertion forces of the subject connector are quite low during the initial engagement of the segments. The insertion force gradually increases in a linear fashion until the segments are fully mated. At this point, the perpendicular force between the contacts matches that of a conventional connector. However, as can be seen from FIG. 7, the average force experienced by the connector elements over the complete engagement cycle is significantly less than the forces associated with a conventional connector. By this arrangement, the segments are not only easier to mate, but in addition, will survive many more insertion cycles because wear will be significantly reduced. (The insertion force related to the electrical contacts discussed here is just one component of overall connector insertion force. The latching features of the connector are the other major contributor of connector insertion force and will be discussed later.)

Figure 5A:
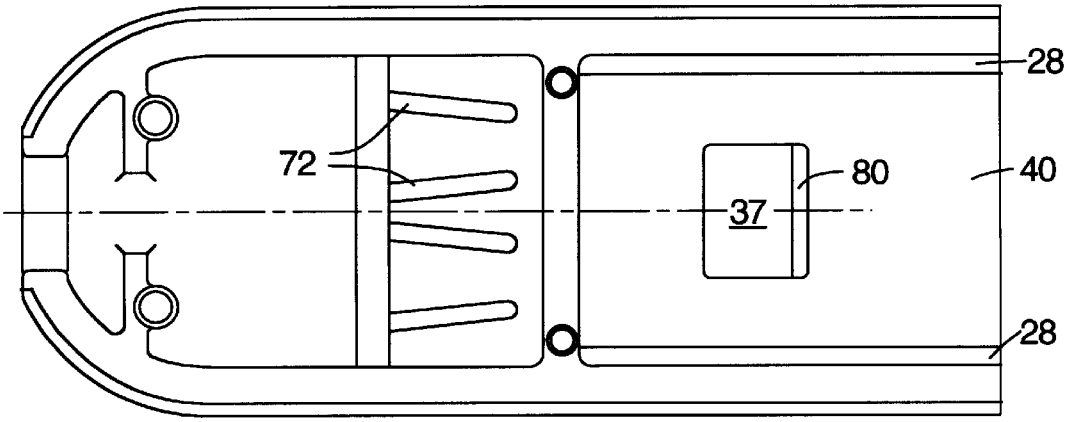
FIG. 5*a* is a bottom view of the upper shell of the amplifier segment.
Figure 5B:
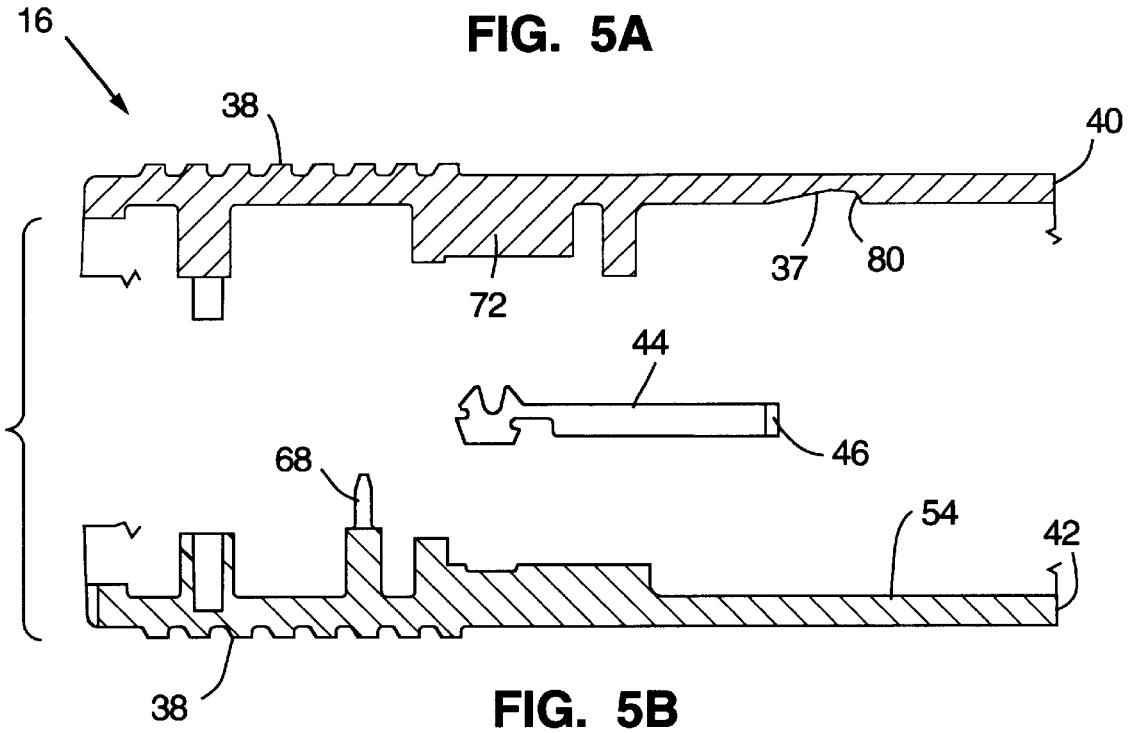
FIG. 5*b* is an exploded side elevation cross-sectional view of the upper and lower shells of the amplifier segment.
Figure 5C:
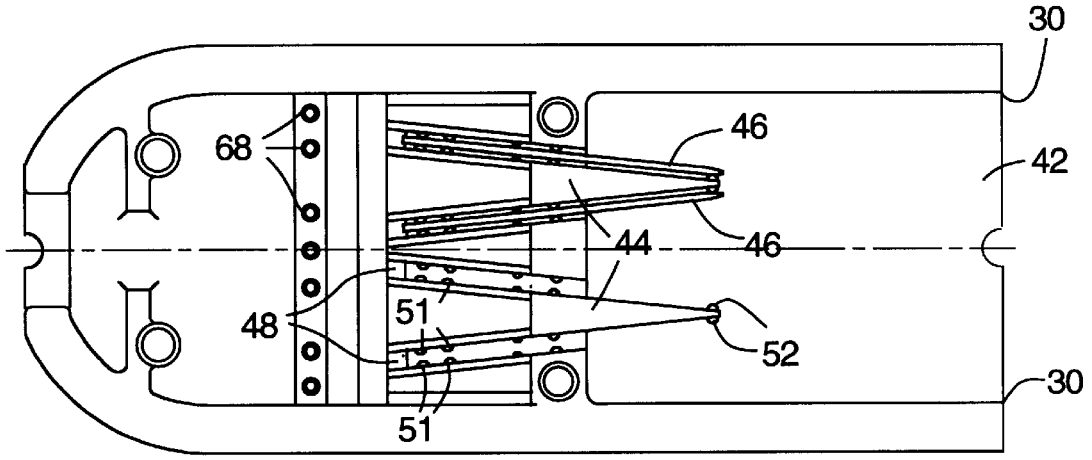
FIG. 5*c* is a plan view of the lower shell of the amplifier segment.

Referring to FIGS. 2 and 5*c,* wire termination on blade contacts 46 within amplifier segment 16 will now be described. The following discussion also applies to wire termination on spring contacts 60 within headset segment 12, which is virtually identical. Preferably, cable 18 includes four discrete, insulated wires (not shown). The end of each wire is individually laid over one of the angled channels 48 and threaded between an associated pair of posts 68. Each blade contact 46 (which has been previously secured in the bottom of a channel 48 as described earlier) is provided with a pair of sharp, insulation piercing points 70 which protrude into the top portion of each channel 48.

Referring to FIGS. 5*a* and 5*b,* upper shell 40 is provided with a series of ridges 72 that align with the channels 48 in the lower shell 42. When upper shell 40 and lower shell 42 are assembled and pressed together, ridges 72 push the wires down over piercing points 70 and completely into the top portion of channels 48.

Figure 8A:
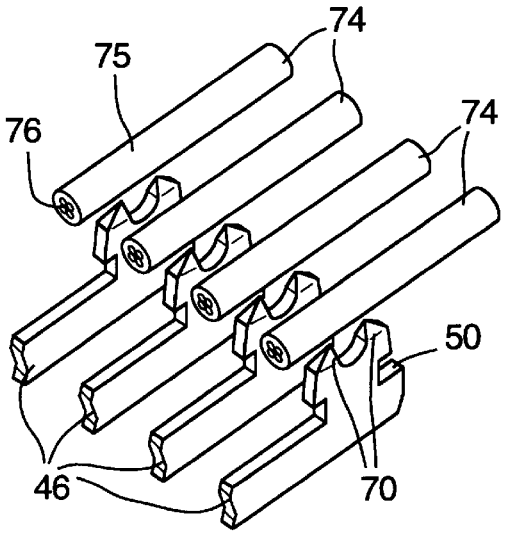
FIG. 8*a* is a perspective view of the wires positioned over the piercing points of the blade contacts.
Figure 8B:
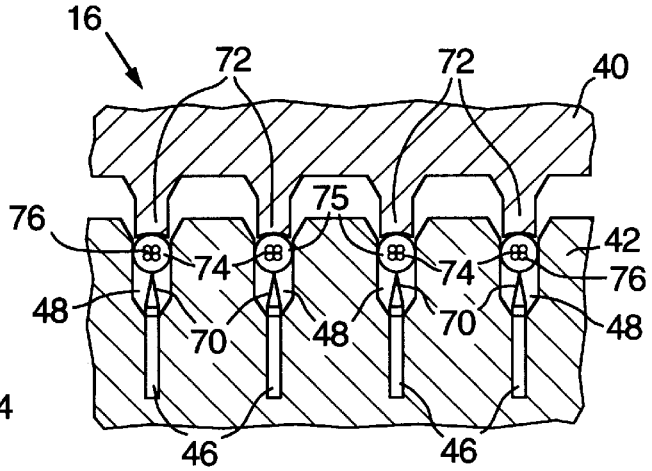
FIG. 8*b* is a cross-sectional end view of the amplifier segment showing the ridges of the upper shell just beginning to push the wires down over the piercing points.

Referring to FIGS. 8*a,* 8*b* and 8*c,* wires 74 are shown before and after piercing. To allow cable 18 to be very flexible, the discrete wires 74 are of a fine diameter. In the preferred embodiment of the amplifier segment 16, the diameter of the outer insulation 75 is 0.040 inches, and the diameter of the inner conductor 76 is 0.022 inches. In the preferred embodiment of the headset segment 12, the diameter of the outer insulation 75 is 0.022 inches, and the diameter of the inner conductor 76 is 0.013 inches. Because of the small diameter of wire conductor 76 (especially on the headset side), it is important for wires 74 to be properly centered over the piercing points 70. To accomplish this, each contact 46 and wire 74 has its own channel 48, and the contacts 46 are accurately centered in the bottom portion of each channel 48 as previously described. The upper portion of channels 48 are accurately located over the lower portions, and are accurately sized so that they preferably are no wider than the insulation diameter of wire 74. Preferably, the upper portions of channels 48 are narrower than the wires 74, creating a slight interference fit with the insulation of the wires 74. These features accurately center the wires 74 over the piercing points 70, as shown in FIG. 8*b*.

Figure 8C:
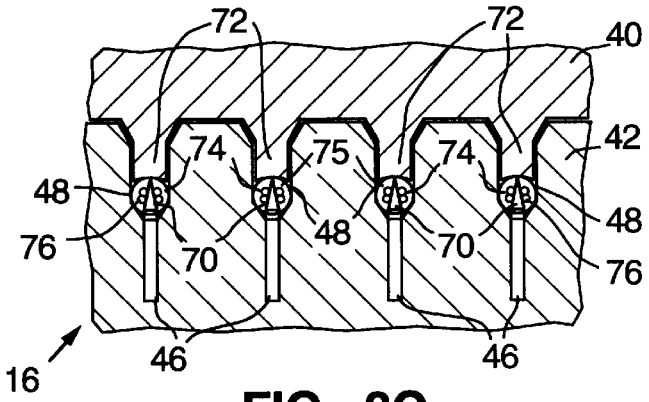
FIG. 8*c* is a cross-sectional end view of the amplifier segment after being fully assembled.

Referring to FIG. 8*c*, amplifier segment 16 is shown in the fully assembled position, after ridges 72 have forced wires 74 over piercing points 70. The combination of ridges 72 and tight fitting channels 48 restricts the expansion of wires 74 in all directions as piercing points 70 penetrate wire 74, thus forcing the individual conductor strands into more intimate contact with the sides of piercing points 70 than would be possible with the less confining space in conventional connectors such as modular phone plugs. This provides an improved electrical connection between the conductors and the piercing points 70. Also, no special crimping tools are required.

Figure 4B:
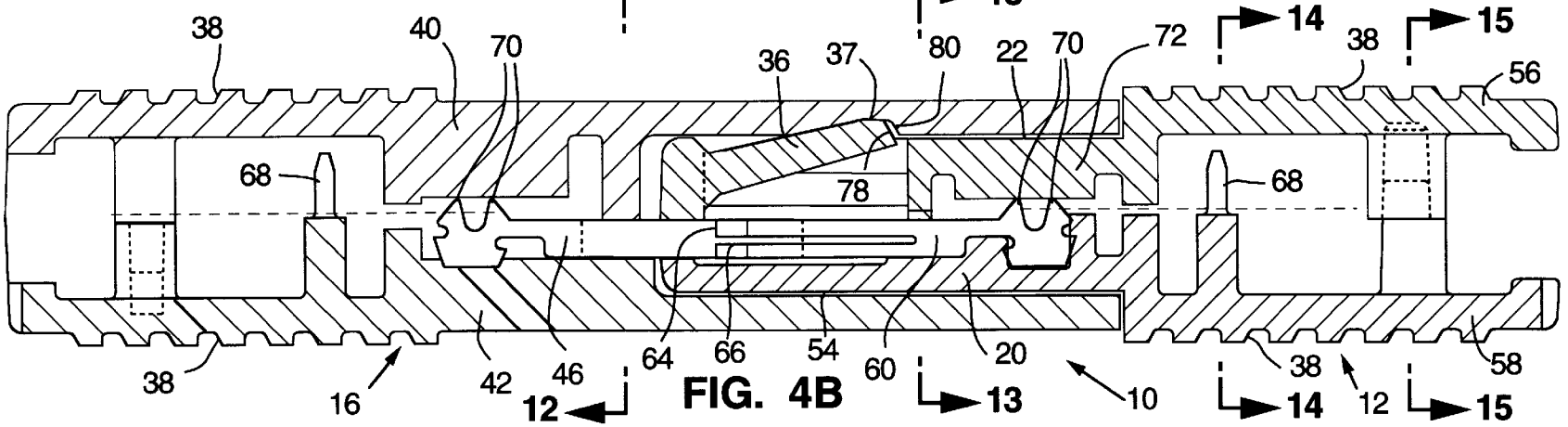
FIG. 4*b* is a side elevation cross-sectional view of the amplifier and headset segments in a mated condition.
Figure 6A:
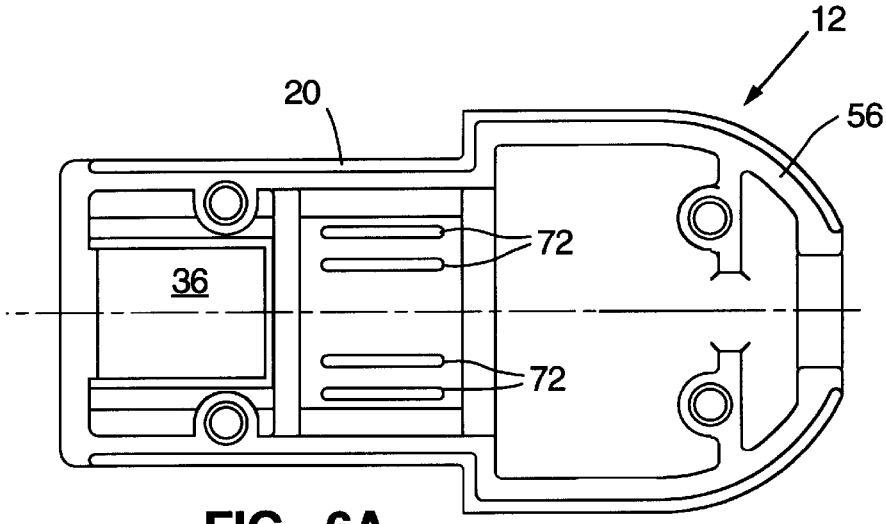
FIG. 6*a* is a bottom view of the upper shell of the headset segment.
Figure 6B:
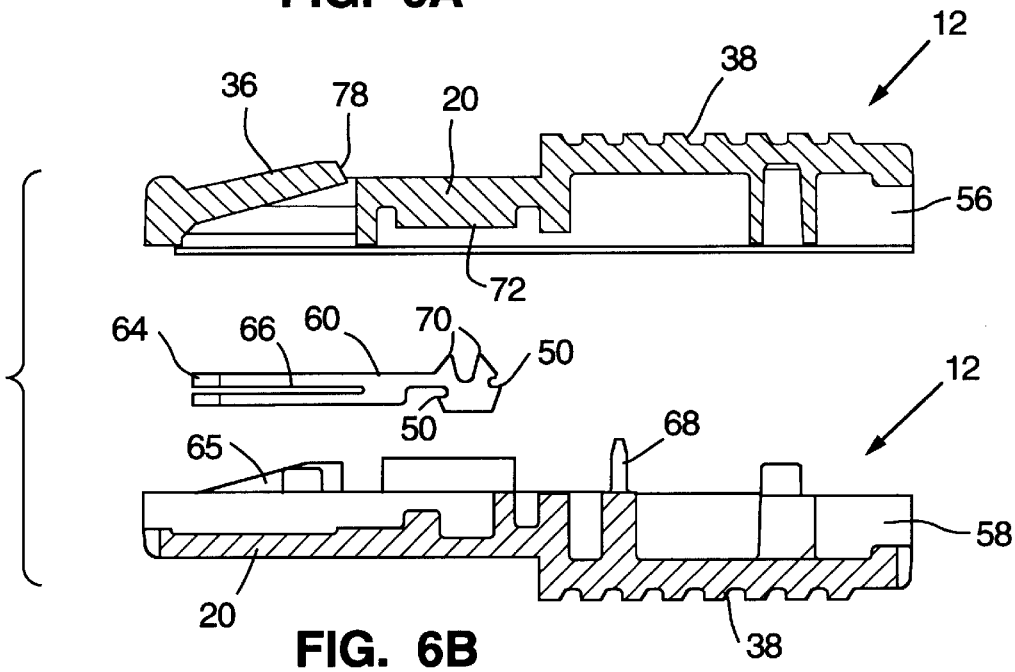
FIG. 6*b* is an exploded side elevation cross-sectional view of the upper and lower shells of the headset segment.
Figure 6C:
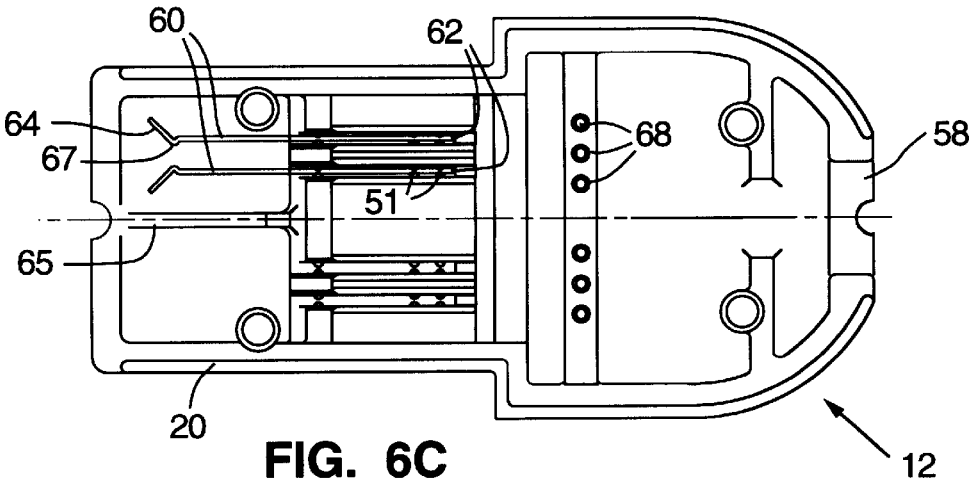
FIG. 6*c* is a plan view of the lower shell of the headset segment.

Referring to FIGS. 4*b*, 5*b* and 6*b*, the latching feature of connector 10 will now be described. Finger 36 is formed on the distal end of protrusion 20 and projects back away from the distal end. Finger 36 is biased downward by the underside of upper shell 40 as it slides along this surface when protrusion 20 is inserted into aperture 22. When protrusion 20 is fully engaged within aperture 22, finger 36 springs back and is received by recess 37 in the underside of upper shell 40. In this position, an angled face 78 on the distal end of finger 36 abuts against a ramped surface 80 of recess 37 to provide a latched engagement between segment 12 and segment 16. To release segment 12 from segment 16, the user pulls the two segments apart with sufficient force to disengage finger 36 from recess 37.

Finger stop 65 is provided on lower shell 58 of headset segment 12 directly under finger 36, and prevents finger 36 from being overextended in the downward direction. Finger stop 65 prevents damage to finger 36, as might occur if a user were to manually depress finger 36 when the two segments 12 and 16 are not mated.

The characteristics of the above latching mechanism are selected to provide four distinct advantages. First, it is desirable for the user to be able to mate the two segments 12 and 16 with very low insertion force. Second, it is desirable to prevent unintentional disconnection, such as might occur if cable 14 were to get caught in the arm of a chair when a user moves his or her head, causing the chair to tug on cable 14 and applying an unmating force to connector 10. Third, it is desirable to have a higher yet consistent unmating force to allow the user to easily release connector 10 without having to do anything more than pull on the segments 12 and 16. Fourth, it is desirable to be able to accomplish the above repeatedly over the course of over 50,000 mating cycles. The discussion below is instructive as to how to achieve all of the above objectives with the inventive latching mechanism.

Figure 9:
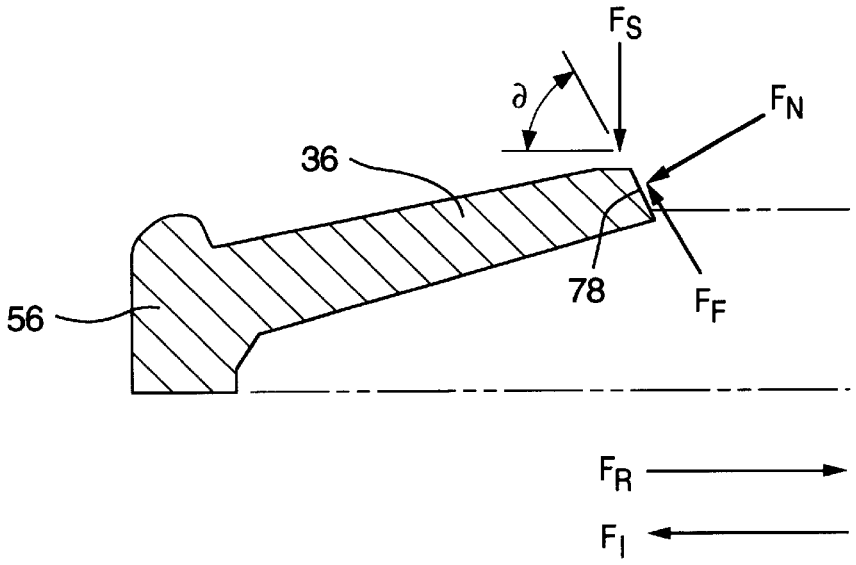
FIG. 9 is a side elevation cross-sectional view of the latching finger, schematically showing the forces exerted on the finger.

Referring to FIG. 9, the forces exerted on latching finger 36 are schematically shown. Spring force $F_S$ is the downward force that is exerted on finger 36 when it is biased by upper shell 40. Normal force $F_N$ is the force exerted perpendicularly to angled face 78 by ramped surface 80. Friction force $F_F$ is the force that is exerted along angled face 78 by ramped surface 80. Insertion force $F_I$ is the force exerted by the user on segments 12 and 16 to insert protrusion 20 into aperture 22. (only the insertion force contributed by the latching finger 36 is considered here, not any insertion force contributed by the electrical contacts, as discussed earlier.) Release force $F_R$ is the force that is exerted by the user on segments 12 and 16 to release the latching finger 36. Latch angle $\alpha$ is the angle of angled face 78 with respect to the longitudinal (horizontal) axis of connector 10. The following formulas are used to calculate the insertion force $F_I$ and the release force $F_R$ for the inventive latching mechanism, based on the latch angle $\alpha$ and the coefficient of friction $\mu$ between the latching finger 36 and the underneath surface of upper shell 40.

$$F_I=\mu\cdot F_S$$

$$F_R=F_S\,\{(\sin\alpha+\mu\cdot\cos\alpha)/(\cos\alpha-\mu\cdot\sin\alpha)\}$$

$$\text{for } \mu<1/\tan\alpha$$

The latching mechanism will not release if $\mu$ is greater than $1/\tan\alpha$ (or in other words, if $\alpha$ is greater than $\tan^{-1}(1/\mu)$.)

Figure 10:
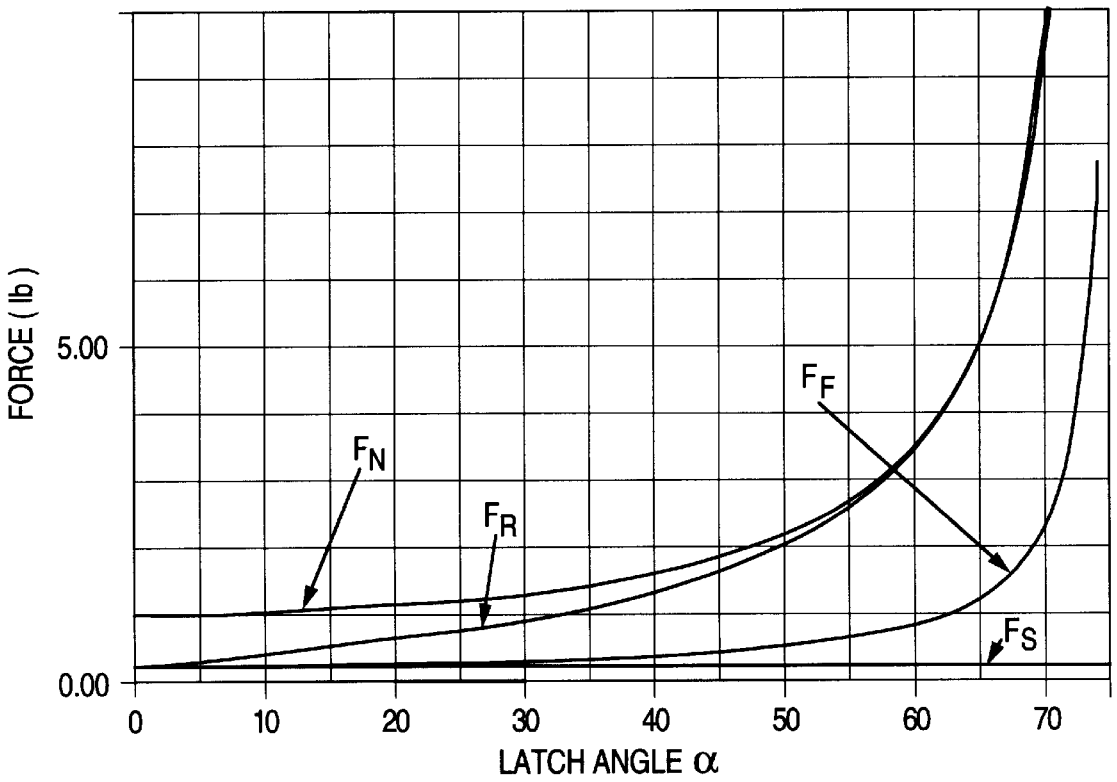
FIG. 10 is a graph showing the effect of latch angle $\alpha$ on the forces shown in FIG. 9 when the spring force $F_S$ is set at 1 pound and the coefficient of friction $\mu$ is 0.25.

Referring to FIG. 10, $F_I$, $F_R$, $F_N$ and $F_F$ are graphed as a function of latch angle $\alpha$ for a spring force $F_S$ of 1 pound and a coefficient of friction of 0.25. (0.25 is the coefficient of friction for the preferred material ABS.)

As implied above, it is desirable to choose appropriate values for latch angle $\alpha$, spring force $F_S$, and coefficient of friction $\mu$ to achieve the stated objectives of the latching mechanism, namely, a low insertion force, an appropriate release force, a consistent release force, and the ability to withstand many mating cycles. As can be seen from FIG. 10 and the formula for $F_I$ above, the insertion force is not dependant on latch angle $\alpha$. For a coefficient of friction $\mu$ of 0.25 (ABS plastic) in the preferred embodiment, the dimensions of latching finger 36 can be chosen to provide a spring force $F_S$ of 1 pound, resulting in an insertion force $F_I$ of a quarter pound. This value of insertion force $F_I$ allows for easy mating of connector 10. Next, an appropriate value for the latch angle $\alpha$ can be chosen using the graph of release force $F_R$ shown in FIG. 10. It is desirable to have connector 10 resist release forces under 2 pounds, and to require no more than 5 pounds to release. As can be seen from FIG. 10, the preferable latch angle $\alpha$ of 50° provides an appropriate release force $F_R$ of 2 pounds, or eight times the insertion force $F_I$. Beyond a latch angle $\alpha$ of 50°, the graph begins to rise sharply. In this range, small variations in latch angle $\alpha$ will produce relatively large variations in the release force $F_R$. Therefore, to provide a consistent release force $F_R$, it is preferable to choose the latch angle $\alpha$ so that it does not lie on the steeper portion of the curve. An additional factor that should be considered when choosing latch angle $\alpha$ is the friction force $F_F$. Since wear of the latching finger is the result of the friction force $F_F$ exerted on angled face 78 by ramped surface 80, reducing this friction will reduce wear and increase cycle life of the latching finger 36. At a latching angle $\alpha$ of 50°, friction force $F_F$ is only about a half pound, and therefore should allow a cycle life of at least 50,000 cycles.

In most connectors, the retention force resisting release is solely the result of friction and thus high retention force implies high wear on whatever surfaces are involve in sliding. In the inventive latching mechanism, the major contributor to the retention force is the horizontal component of the normal force $F_N$, not the friction force $F_F$. Therefore, the present invention is able to achieve a high retention force (many times higher than the insertion force) by exploiting the mechanical advantage of angled face 78 against ramped surface 80, not by brute force means employing high friction. The design and operation of the inventive latching mechanism is very simple, requiring only that the user push to couple and pull to release.

The positions of latching finger 36 and recess 37 can be swapped if desired (not shown). In other words, latching finger 36 could be located within aperture 22 in amplifier segment 16, and recess 37 could be located on protrusion 20 on headset segment 12.

While the present invention is disclosed by reference to the examples and preferred embodiment detailed above, it is to be understood that this embodiment is intended in an illustrative rather than limiting sense, as it is contemplated that modifications will readily occur to those skilled in the art, which modifications will be within the spirit of the invention and the scope of the appended claims.

What is claimed is:

1. An electrical connector comprising:

a first shell having a generally rectangular configuration and having a generally rectangular projection at one of its ends;

a second shell having a generally rectangular configuration and having a complementary shaped chamber at one of its ends for receiving the projection of the first shell when the two shells are mated, each of the two shells having grip features formed on opposite sides of the shell for receiving a user's thumb and forefinger for gripping the shell; and means for releasably interlocking the two shells, the interlocking means having features located on an outer surface of the projection and on an opposing inner surface of the chamber, the interlocking means including a resilient cantilevered finger formed on a distal portion of one of the two surfaces and projecting back away from the distal portion, and a deflecting surface formed on the other of the two surfaces for biasing the finger when the projection is partially received within the chamber, the finger being in a spatially fixed location relative to the gripping features which are located on the shell with the cantilevered finger, the deflecting surface having a recessed ramped surface positioned such that when the projection is fully inserted into the chamber the finger is allowed to return to a less biased position in which an angled face at the distal end of the finger abuts the ramped surface, thereby releasably locking the two shells together, the two shells being released by the user grasping the grip features of the first and second shells and pulling the two shells in opposite directions with sufficient force for the ramped surface to urge the angled face of the finger out of contact with the ramped surface, wherein the angular orientation of the angled face is selected so that the two shells can be released by a force that is greater than that required to mate the two shells.

2. A connector as recited in claim 1, wherein the angular orientation of the angled face is selected so that the two shells can be released by a force that is two to fourteen times greater than that required to mate the two shells.

3. A connector as recited in claim 1, wherein the ramped surface is oriented to be substantially parallel to the angled face when the two shells are mated.

4. A connector as recited in claim 1, wherein the angled face forms at least a 30 degree angle but no more than a 60 degree angle with a longitudinal axis of the connector.

5. A connector as recited in claim 1, wherein the ramped surface forms a 50 degree angle with a longitudinal axis of the connector, and the two shells can be released by a force that is roughly eight times a force required to mate the shells.

6. A connector as recited in claim 1, wherein the angular orientation of the angled face, the biasing force exerted by the deflecting surface on the finger, and the coefficient of friction between the angled face and the ramped and deflecting surfaces are all selected so that the force required to lock the shells together is roughly a quarter pound and the force required to release the two shells is roughly 2 pounds.

* * * * *